US010210972B2

(12) United States Patent
Yue et al.

(10) Patent No.: US 10,210,972 B2
(45) Date of Patent: Feb. 19, 2019

(54) HEAT-RESISTANT ISOTROPIC BONDED NDFEB MAGNET AND ITS PREPARATION TECHNOLOGY

(71) Applicant: BEIJING UNIVERSITY OF TECHNOLOGY, Beijing (CN)

(72) Inventors: Ming Yue, Beijing (CN); Yuxia Yin, Beijing (CN); Weiqiang Liu, Beijing (CN); Ruijin Hu, Beijing (CN); Dongtao Zhang, Beijing (CN); Chenglin Li, Beijing (CN)

(73) Assignee: BEIJING UNIVERSITY OF TECHNOLOGY, Beijing (CN)

( * ) Notice: Subject to any disclaimer, the term of this patent is extended or adjusted under 35 U.S.C. 154(b) by 0 days.

(21) Appl. No.: 15/567,957

(22) PCT Filed: Mar. 8, 2016

(86) PCT No.: PCT/CN2016/075843

§ 371 (c)(1),
(2) Date: Oct. 19, 2017

(87) PCT Pub. No.: WO2017/063329

PCT Pub. Date: Apr. 20, 2017

(65) Prior Publication Data

US 2018/0166191 A1 Jun. 14, 2018

(30) Foreign Application Priority Data

Oct. 12, 2015 (CN) ..... 2015 1 0660957

(51) Int. Cl.

| | |
|---|---|
| ***B22F 1/00*** | (2006.01) |
| ***B22F 3/03*** | (2006.01) |
| ***H01F 7/02*** | (2006.01) |
| ***H01F 1/057*** | (2006.01) |
| ***H01F 41/02*** | (2006.01) |
| ***C22C 33/02*** | (2006.01) |
| ***C22C 38/00*** | (2006.01) |

(52) U.S. Cl.

CPC ..... *H01F 1/0576* (2013.01); *B22F 1/0059* (2013.01); *B22F 3/03* (2013.01); *C22C 33/0278* (2013.01); *C22C 38/00* (2013.01); *H01F 1/057* (2013.01); *H01F 7/02* (2013.01); *H01F 41/0266* (2013.01); *B22F 2301/45* (2013.01); *C22C 2202/02* (2013.01)

(58) Field of Classification Search

CPC ..... H10F 1/0578; H10F 7/02; H10F 41/026; B22F 2301/1355

See application file for complete search history.

(56) References Cited

U.S. PATENT DOCUMENTS 6,890,381 B2 * 5/2005 Ozawa ..... H01F 1/0558 106/640

FOREIGN PATENT DOCUMENTS

| | | | |
|---|---|---|---|
| CN | 102007549 A | | 4/2011 |
| CN | 104070161 A | | 10/2014 |
| CN | 104575911 A | | 4/2015 |
| CN | 102982961 B | | 8/2015 |
| CN | 105206369 A | * | 12/2015 |
| CN | 105206370 A | | 12/2015 |
| JP | H09-129466 | | 5/1997 |

OTHER PUBLICATIONS

Translation for CN 105206369 A, Dec. 20, 2015.*
Abstract for CN 105206369 A, Dec. 20, 2015.*
The Chinese First Examination Report of corresponding Chinese application No. 201510660957.3, dated Nov. 9, 2016.
Li Fei, "Current Status of Development and Application for Bonded Nd—Fe—B Magnets" Chinese Rare Earths; Apr. 1999; pp. 63-66.
International Search Report of corresponding International PCT Application No. PCT/CN2016/075843, dated Jul. 6, 2016.

* cited by examiner

*Primary Examiner* — C Melissa Koslow
(74) *Attorney, Agent, or Firm* — J.C. Patents

(57) ABSTRACT

This patent invents a heat-resistant isotropic bonded NdFeB magnet and its preparation technology, belonging to the field of magnetic materials. In present invention, isotropic NdFeB magnetic powders is used as magnetic material, sodium silicate is used as principal binder, and epoxy resin is used as auxiliary binder to prepare heat-resistant isotropic bonded NdFeB magnets. The prepared magnets have greatly increased heat resistance to stand an operating temperature of 200° C., and have advantages of penetration and corrosion resistance. The invented heat-resistant isotropic bonded NdFeB magnets feature good magnetic properties and high operating temperature. During the preparation process, it has the advantage of simple equipment, easy operation, low cost. The technology is easy to large scale production, and has high economic value and huge application prospect in the field of permanent magnetic materials.

7 Claims, No Drawings

HEAT-RESISTANT ISOTROPIC BONDED NDFEB MAGNET AND ITS PREPARATION TECHNOLOGY

CROSS-REFERENCE TO RELATED APPLICATION

This application is a national phase application of international application number PCT/CN2016/075843, filed on Mar. 8, 2016, and titled "A Heat-resistant Isotropic Bonded NdFeB Magnet and Its Preparation Technology", which in turn claims the priority benefits of Chinese Patent Application No. 201510660957.3, filed on Oct. 12, 2015, the contents of the above identified applications are hereby incorporated by reference in their entirety.

TECHNICAL FIELD

This patent invents a heat-resistant isotropic bonded NdFeB magnet and its preparation technology, belonging to the field of magnetic materials.

BACKGROUND

The consolidation process of permanent magnetic material includes sintering process and binding process with their advantages and disadvantages. Sintered magnets have good magnetic property, but complicated fabrication process and high price. Bonded magnets exhibit slightly lower magnetic property, but have advantages of easy large scale production, precise dimension, low density, stable magnetic property and multi-polarized magnetizing, leading to extensive application in electronics industry and medical industry. Currently there are four methods used for preparing bonded magnet: compression molding, injection moulding, extrusion molding and calendaring molding. There have been many researches and applications regarding compression molding and injection molding. Especially compression molding has been deeply researched and widespread applied, due to small amount of additive, higher magnetic property and simple molding method. The amount of additive is generally to the extent where a thin coating forms on the surface of every magnetic particle, and this is usually related to the structure of magnetic particle used and particle size distribution.

In preparation of bonded NdFeB permanent magnet via compression molding, the epoxy resin with an amount about 3% of magnets mass is selected as binder due to its excellent alkali resistance and low curing shrinkage rate. The epoxy resin bonded NdFeB magnets prepared by compression molding have high coercivity, but they could not used under high temperature, and their operating working temperature is limited under 110° C., due to weak temperature tolerance of epoxy resin binder (Li Fei, Current Status on the Development and Application of bonded NdFeB Magnet [J]. Rare Earth, 1999, 63-66). To increase the temperature tolerance of bonded NdFeB magnets, it has become an important issue of developing the heat-resistant binders to improve the working temperature of bonded magnets. The heat-resistant isotropic bonded NdFeB magnets with sodium silicate as principal binder and heat-resistant epoxy resin as auxiliary binder in present invention could effectively strengthen the magnets' temperature tolerance, and their working environment temperature is up to 200° C.

A Japanese patent reports a preparation method for bonded magnet component by mixing magnetic powders with sodium silicate binder. The components could work on engines and power generators under relatively high temperature. However, due to high moisture absorption, the magnet needs surface processing before use (JPH09129466, Minami Tadashi, Nakamura Katsuya, Odakane Masaaki. Manufacture of bond magnet. Japan, H01F 41/02, 1997.). If sodium silicate and epoxy resin are used together as binder, the bonded NdFeB magnet will combine the merits of the sodium silicate and epoxy resin bonded magnets, exhibiting unique advantages of temperature tolerance, reinforcing & toughening, penetration resistance & moisture absorption resistance, and corrosion resistance, etc. Sodium silicate has good heat resistance and strength to offset the shortcoming in temperature tolerance of epoxy resin and improve the strength property of magnets. Also epoxy resin permeates into sodium silicate at molecular level, and forms interpenetrating network structure between sodium silicate and epoxy resin after cross-linking and solidifying, which greatly improves the penetration resistance and corrosion resistance of the magnets, while further reduces its moisture absorption.

The present invention uses isotropic NdFeB magnetic powders as magnetic material, sodium silicate as principal binder, and heat-resistant epoxy resin as auxiliary binder. The isotropic bonded NdFeB magnet prepared in present invention has greatly increased temperature tolerance with a working temperature of 200° C. as well as advantages of penetration resistance and corrosion resistance.

DISCLOSURE OF THE INVENTION

The present invention aims to provide a heat-resistant isotropic bonded NdFeB magnet and its preparation technology, which has the advantages of easy attainable raw materials, easy large scale production, and low cost.

A heat resistant isotropic bonded NdFeB magnet in present invention is comprised with the following materials: isotropic NdFeB powders and binder as the main materials with proper surfactant and lubricant. The mass ratios of the main materials are 90~96% of isotropic NdFeB powders, 3~6.5% of sodium silicate binder, 0.5~3.3% of epoxy resin binder, 0.1~0.3% of surfactant, and 0.1~0.3% of lubricant.

The above mentioned sodium silicate binder is sodium silicate aqueous solution with modulus of 3.1~3.4 and Baume degree of 39~41°.

The above mentioned surfactants are preferred to be KH-550 (3-aminopropyltriethoxysilane), KH560 (γ-(2,3-epoxypropoxy)propytrimethoxysane), stearic acid, aluminate ester, and titanate ester.

The above mentioned lubricants are preferred to be paraffin, glycerol, silicate ester, and silicone oil.

A method for preparing heat resistant isotropic bonded NdFeB magnets in present invention comprises the following steps:

(1) The bonded magnetic powders A is obtained by mixing isotropic NdFeB magnetic powders with a certain mass of surfactant and stirring evenly;

(2) The bonded magnetic powders B is obtained by mixing bonded magnetic powders A prepared in step (1) with a certain mass of epoxy resin binder and stirring evenly until it becomes loose powders;

(3) The bonded magnetic powders C is obtained by mixing bonded magnetic powders B prepared in step (2) with a certain mass of sodium silicate and stirring evenly until it becomes loose powders;

(4) The bonded magnetic powders D is obtained by mixing bonded magnetic powders C prepared in step (3) with a certain mass of lubricant and stirring evenly;

(5) The bonded magnetic powders E is obtained by spraying a small amount of organic solvent to bonded magnetic powders D prepared in step (4) to volatilize water of the binder and stirring evenly until it becomes loose powders;

(6) The initial green compact F is obtained by pressing bonded magnetic powders E prepared in step (5) in moulding press machine;

(7) The densely compact G is obtained by densifying initial green compact F prepared in step (6) in isostatic pressing machine;

(8) The heat resistant isotropic bonded NdFeB magnets is obtained by curing densely compact G prepared in step (7), and the curing temperature is 175~200° C. and curing time is 30~40 min.

The above mentioned epoxy resin is diluted and dissolved with acetone before using. After dissolution, it is used immediately.

The above mentioned organic solvent is one of acetone, methyl alcohol, ethyl alcohol and ethyl acetate, or a mixture of them.

The conventional isotropic bonded NdFeB magnets can be easily mass-produced with precise dimension via commonly molding process. However, the working temperature of the conventional isotropic bonded NdFeB magnets is low for long term use, which is no more than 110° C., limiting its application in some fields. Therefore, development of heat-resistant isotropic bonded NdFeB magnets brings not only important application prospect in the field of permanent magnet materials, but also huge economic value.

Compared with existing technologies, the present invention has the following merits:

The invented heat-resistant isotropic bonded NdFeB magnet and preparation technology features good magnetic property and high operating temperature (200° C.). The present invention involves the advantages of simple equipment, easy operation and low cost in product preparation, facilitates large scale production, and has high economic value. Therefore, the present invention has huge application prospect in the field of permanent magnet materials.

DETAILED DESCRIPTION OF THE PREFERRED EMBODIMENTS

The following examples describe this disclosure, but do not limit the coverage of the disclosure.

Example 1: A Method for Preparing Heat Resistant Isotropic Bonded NdFeB Magnets Comprises the Following Steps Step one: The bonded magnetic powders A1 is obtained by mixing 96 g isotropic NdFeB magnetic powders with 0.3 g KH-550 and stirring evenly;

Step two: The bonded magnetic powders B1 is obtained by mixing bonded magnetic powders A1 prepared in step one with 0.5 g epoxy resin and stirring evenly until it becomes loose powders;

Step three: The bonded magnetic powders C1 is obtained by mixing bonded magnetic powders B1 prepared in step two with 3 g sodium silicate (modulus of 3.1 and Baume degree of 40°) and stirring evenly until it becomes loose powders;

Step four: The bonded magnetic powders D1 is obtained by mixing bonded magnetic powders C1 prepared in step three with 0.2 g paraffin and stirring evenly;

Step five: The bonded magnetic powders E1 is obtained by spraying 3 ml acetone to bonded magnetic powders D1 prepared in step four and stirring evenly until it becomes loose powders;

Step six: The initial green compact F1 is obtained by pressing bonded magnetic powders E1 prepared in step five in moulding press machine;

Step seven: The densely compact G1 is obtained by densifying initial green compact F1 prepared in step six in isostatic pressing machine;

Step eight: The heat resistant isotropic bonded NdFeB magnets 1# is obtained by curing densely compact G1 prepared in step seven, wherein the curing temperature is 175° C. and curing time is 40 min.

The sodium silicate binder is replaced by the same mass epoxy resin binder to prepare isotropic bonded NdFeB magnets 1"# via the same process as Example One. The temperature coefficients of isotropic bonded NdFeB magnet 1# and 1"# are shown in Table 1, and their magnetic properties are shown in Table 2.

TABLE 1

Temperature coefficients of isotropic bonded NdFeB magnet 1# and 1"#

| | Temperature Coefficient of Remanence α1 (%/° C.) | Temperature Coefficient of Coercivity β1 (%/° C.) |
|---|---|---|
| 1# | −0.127 (20~200° C.) | −0.271 (20~200° C.) |
| 1"# | −0.095 (20~100° C.) | −0.526 (20~100° C.) |

Note:
Bonded magnet 1"# with epoxy resin as the only binder has an operating environment temperature of no more than 110° C..

TABLE 2

Magnetic properties of isotropic bonded NdFeB magnet 1# and 1"#

| | Remanence (kGs) | Coercivity (kOe) | Magnetic Energy Product (MGOe) |
|---|---|---|---|
| 1# (Room temperature) | 6.245 | 9.302 | 8.339 |
| 1# (200° C.) | 4.817 | 4.764 | 3.801 |
| 1"# (Room temperature) | 6.021 | 9.543 | 7.820 |
| 1"# (200° C.) | / | / | / |

Note:
Bonded magnet 1"# with epoxy resin as the only binder is broken when it is tested at 200° C.. Therefore, the data is not obtained.

Example 2: A Method for Preparing Heat Resistant Isotropic Bonded NdFeB Magnets Comprises the Following Steps Step one: The bonded magnetic powders A2 is obtained by mixing 93 g isotropic NdFeB magnetic powders with 0.2 g KH-560 and stirring evenly;

Step two: The bonded magnetic powders B2 is obtained by mixing bonded magnetic powders A2 prepared in step one with 1.5 g epoxy resin and stirring evenly until it becomes loose powders;

Step three: The bonded magnetic powders C2 is obtained by mixing bonded magnetic powders B2 prepared in step two with 5 g sodium silicate (modulus of 3.2 and Baume degree of 39°) and stirring evenly until it becomes loose powders;

Step four: The bonded magnetic powders D2 is obtained by mixing bonded magnetic powders C2 prepared in step three with 0.3 g glycerol and stirring evenly;

Step five: The bonded magnetic powders E2 is obtained by spraying 4 ml acetone to bonded magnetic powders D2 prepared in step four and stirring evenly until it becomes loose powders;

Step six: The initial green compact F2 is obtained by pressing bonded magnetic powders E2 prepared in step five in moulding press machine;

Step seven: The densely compact G2 is obtained by densifying initial green compact F2 prepared in step six in isostatic pressing machine;

Step eight: The heat resistant isotropic bonded NdFeB magnets 1# is obtained by curing densely compact G2 prepared in step seven, wherein the curing temperature is 185° C. and curing time is 35 min.

The sodium silicate binder is replaced by the same mass epoxy resin binder to prepare isotropic bonded NdFeB magnets 2"# via the same process as Example One. The temperature coefficients of isotropic bonded NdFeB magnet 1# and 2"# are shown in Table 3, and their magnetic properties are shown in Table 4.

TABLE 4

Temperature coefficients of isotropic bonded NdFeB magnet 2# and 2"#

| | Temperature Coefficient of Remanence α1 (%/° C.) | Temperature Coefficient of Coercivity β1 (%/° C.) |
|---|---|---|
| 2# | −0.129 (20~200° C.) | −0.290 (20~200° C.) |
| 2"# | −0.144 (20~100° C.) | −0.432 (20~100° C.) |

Note:
Bonded magnet 2"# with epoxy resin as the only binder has an operating environment temperature of no more than 110° C..

TABLE 4

Magnetic properties of isotropic bonded NdFeB magnet 2# and 2"#

| | Remanence (kGs) | Coercivity (kOe) | Magnetic Energy Product (MGOe) |
|---|---|---|---|
| 2# (Room temperature) | 5.522 | 9.460 | 6.655 |
| 2# (200° C.) | 4.240 | 4.522 | 2.494 |
| 2"# (Room temperature) | 4.281 | 8.576 | 4.039 |
| 2"# (200° C.) | / | / | / |

Note:
Bonded magnet 2"# with epoxy resin as the only binder is broken when it is tested at 200° C.. Therefore, the data is not obtained.

Example 3: A Method for Preparing Heat Resistant Isotropic Bonded NdFeB Magnets Comprises the Following Steps Step one: The bonded magnetic powders A3 is obtained by mixing 96 g isotropic NdFeB magnetic powders with 0.1 g KH-570 and stirring evenly;

Step two: The bonded magnetic powders B3 is obtained by mixing bonded magnetic powders A3 prepared in step one with 3.3 g epoxy resin and stirring evenly until it becomes loose powders;

Step three: The bonded magnetic powders C3 is obtained by mixing bonded magnetic powders B3 prepared in step two with 6.5 g sodium silicate (modulus of 3.4 and Baume degree of 41°) and stirring evenly until it becomes loose powders;

Step four: The bonded magnetic powders D3 is obtained by mixing bonded magnetic powders C3 prepared in step three with 0.1 g paraffin and stirring evenly;

Step five: The bonded magnetic powders E3 is obtained by spraying 5 ml acetone to bonded magnetic powders D3 prepared in step four and stirring evenly until it becomes loose powders;

Step six: The initial green compact F3 is obtained by pressing bonded magnetic powders E3 prepared in step five in moulding press machine;

Step seven: The densely compact G3 is obtained by densifying initial green compact F1 prepared in step six in isostatic pressing machine;

Step eight: The heat resistant isotropic bonded NdFeB magnets 3# is obtained by curing densely compact G3 prepared in step seven in vacuum, wherein the curing temperature is 200° C. and curing time is 30 min.

The sodium silicate binder is replaced by the same mass epoxy resin binder to prepare isotropic bonded NdFeB magnets 3"# via the same process as Example One. The temperature coefficients of isotropic bonded NdFeB magnet 3# and 3"# are shown in Table 5, and their magnetic properties are shown in Table 6.

TABLE 5

Temperature coefficients of isotropic bonded NdFeB magnet 3# and 3"#

| | Temperature Coefficient of Remanence α1 (%/° C.) | Temperature Coefficient of Coercivity β1 (%/° C.) |
|---|---|---|
| 3# | −0.132 (20~200° C.) | −0.368 (20~200° C.) |
| 3"# | −0.164 (20~100° C.) | −0.667 (20~100° C.) |

Note:
Bonded magnet 3"# with epoxy resin as the only binder has an operating environment temperature of no more than 110° C..

TABLE 6

Magnetic properties of isotropic bonded NdFeB magnet 3# and 3"#

| | Remanence (kGs) | Coercivity (kOe) | Magnetic Energy Product (MGOe) |
|---|---|---|---|
| 3# (Room temperature) | 4.622 | 8.640 | 4.709 |
| 3# (200° C.) | 3.524 | 2.917 | 1.105 |
| 3"# (Room temperature) | 4.281 | 8.576 | 4.039 |
| 3"# (200° C.) | / | / | / |

Note:
Bonded magnet 3"# with epoxy resin as the only binder is broken when it is tested at 200° C.. Therefore, the data is not obtained.

What is claimed is:

1. A heat resistant isotropic bonded NdFeB magnet comprising about 90-96 mass % of isotropic NdFeB powders, about 3-6.5 mass % of sodium silicate binder, about 0.5-3.3 mass % of epoxy resin binder, about 0.1-0.3 mass % of surfactant, and about 0.1-0.3 mass % of lubricant.

2. The heat resistant isotropic bonded NdFeB magnet according to claim 1, wherein the sodium silicate binder is sodium silicate aqueous solution with modulus of about 3.1-3.4 and Baume degree of 39~41°.

3. The heat resistant isotropic bonded NdFeB magnet according to claim 1, wherein the surfactant is KH-550 (3-aminopropyltriethoxysilane), KH560 (γ-(2,3-epoxypropoxy)propytrimethoxysilane), stearic acid, aluminate ester, titanate ester, or a mixture thereof.

4. The heat resistant isotropic bonded NdFeB magnet according to claim 1, wherein the lubricant is paraffin, glycerol, silicate ester, silicone oil, or a mixture thereof.

5. A method for preparing heat resistant isotropic bonded NdFeB magnet according to claim 1, comprising the following steps:

(1) mixing isotropic NdFeB magnetic powders with a surfactant and stirring evenly to obtain bonded magnetic powders A;

(2) mixing bonded magnetic powders A with epoxy resin binder and stirring evenly until it becomes loose powders to obtain bonded magnetic powders B;

(3) mixing bonded magnetic powders B with sodium silicate binder and stirring evenly until it becomes loose powders to obtain bonded magnetic powders C;

(4) mixing bonded magnetic powders C with a lubricant and stirring evenly to obtain bonded magnetic powders D;

(5) spraying an organic solvent to bonded magnetic powders D to volatilize water of the binder and stirring evenly until it becomes loose powders to obtain bonded magnetic powders E;

(6) pressing bonded magnetic powders E in a moulding press machine to obtain an initial green compact F;

(7) densifying the initial green compact F in an isostatic pressing machine to obtain a densely compact G; and (8) curing the densely compact G at about 175-200° C. for about 30-40 min to obtain the heat resistant isotropic bonded NdFeB magnet.

6. The method according to claim 5, wherein the epoxy resin binder is diluted and dissolved in acetone before using and immediately mixed with bonded magnetic powders B.

7. The method according to claim 5, wherein the organic solvent is one of acetone, methyl alcohol, ethyl alcohol and ethyl acetate and a mixture thereof.

* * * * *